US006880445B2

(12) United States Patent
Benyami et al.

(10) Patent No.: US 6,880,445 B2
(45) Date of Patent: Apr. 19, 2005

(54) EXPLOSIVE MATRIX FOR A REACTIVE ARMOR ELEMENT

(75) Inventors: Moshe Benyami, Haifa (IL); Samuel Friling, Kfar Uradim (IL); Moshe Paz, Kfar Uradim (IL); Ron Gemussov, Haifa (IL)

(73) Assignee: Rafael Armament Development Authority Ltd., Haifa (IL)

( * ) Notice: Subject to any disclaimer, the term of this patent is extended or adjusted under 35 U.S.C. 154(b) by 0 days.

(21) Appl. No.: 10/447,204

(22) Filed: May 28, 2003

(65) Prior Publication Data

US 2004/0050239 A1 Mar. 18, 2004

(30) Foreign Application Priority Data

Jul. 4, 2002 (IL) ..... 150578

(51) Int. Cl.[7] ..... F41H 11/00
(52) U.S. Cl. ..... 89/36.17; 89/36.08; 89/36.02
(58) Field of Search ..... 89/36.01, 36.02, 89/36.07, 36.08, 36.17

(56) References Cited

U.S. PATENT DOCUMENTS

| | | | | |
|---|---|---|---|---|
| 4,368,660 A | | 1/1983 | Held | |
| 4,741,244 A | * | 5/1988 | Ratner et al. | 89/36.17 |
| 5,070,764 A | | 12/1991 | Shevach et al. | |
| 5,637,824 A | | 6/1997 | Benyami | |
| 5,824,941 A | * | 10/1998 | Knapper | 89/36.17 |
| 6,345,563 B1 | * | 2/2002 | Middione et al. | 89/36.17 |

* cited by examiner

*Primary Examiner*—J. Woodrow Eldred
(74) *Attorney, Agent, or Firm*—Katten Muchin Zavis Rosenman

(57) ABSTRACT

A reactive armor element for protection against a shaped-charge warhead, comprising a casing fitted with an outer metal cover plate, and at least one explosive matrix extending between the metal plates. The explosive matrix comprises a substantially flat carrier plate formed with a plurality of compartments formed by adjoining divider ribs, with explosive material embedded between the ribs.

53 Claims, 4 Drawing Sheets

EXPLOSIVE MATRIX FOR A REACTIVE ARMOR ELEMENT

FIELD OF THE INVENTION

The present invention is concerned with elements for making a protective reactive armor to be fitted on the outside of an enclosure liable to be exposed to attack by shaped-charge warheads and kinetic energy projectiles.

Examples of enclosures protectable by a reactive armor element made of elements according to the invention are land vehicles such as battle tanks, armored personnel carriers, armored fighting vehicles, armored self-propelled guns; armored static structures such as buildings, above-ground portions of bunkers, container tanks for the storage of fuel and chemicals; etc. A reactive armor element according to the invention may be a basic type armor made integral with a conventional passive armor, or alternatively be of the add-on type.

BACKGROUND OF THE INVENTION

Warheads with shaped-charge munition, also known as hollow charge munition, are known to pierce enclosures such as armor and thereby destroy the protected object from within. This capacity of a shaped charge results from the fact that upon detonation there forms an energy-rich jet also known as "thorn" or "spike" which advances at very high speed of several thousand meters per second and is thereby capable of piercing even relatively thick armor walls.

Several arrangements have become available in recent years to afford protection against the penetrating effect of an exploding shaped charge. Examples of such arrangements are disclosed in U.S. Pat. Nos. 4,368,660, 4,741,244, 5,070,764 and 5,637,824, to the same inventor as of the present invention.

All of these prior art reactive armors are concerned with a structure holding at least one reactive armor element wherein the reactive armor element comprises an array of layers comprising one or more plate layers and at least one layer of explosive material tightly bearing against at least one of the plate layers. The plate layers are made, for example, of metal or a composite material. A basic reactive armor element comprises two metal plates sandwiching between them the layer of explosive material. Such prior art reactive armor elements are based on the mass and energy consuming effects of moving plates and their functioning is conditional on the existence of an acute angle between the jet of an oncoming hollow charge threat and the armor itself.

According to some variations, the reactive armor element is a multi-layer composite body in which each layer tightly bears against each contiguous layer, wherein the multi-layer composite body includes an outer metal cover plate, at least one explosive layer, at least one intermediary inert body adjacent to each of the at least one explosive layer and which is thicker than an aggregate thickness of the outer cover plate and any adjacent explosive layer, and a metal base plate, whereby on initiation of the explosive layer a succession of dynamic collapse cycles occurs in which at least one intermediary inert body collapses into a crater formed by a penetrating jet originating from an oncoming shaped-changed warhead.

Reactive armor elements of the concerned types thus disclose an arrangement wherein the explosive material tightly bears, in a sandwiching-like manner, between neighboring layers of plate members, this being a condition for effectively handling the threat of an oncoming shaped-charge warhead.

However, a problem occurs when for some reason the explosive material disengages from the adjoining plate layer. Such reasons are, for example, loose contact between the explosive layer and the bearing plate, absence of adherence therebetween, deformation of the bearing plate e.g. by a kinetic projectile (shrapnel, bullets, etc), a weak jet of a shaped-charge warhead which fails to detonate the explosive material although its impact on the plate, or even on the explosive material, will deform one or both of the plate members and the explosive material, etc. Upon deformation of the plate member or of the explosive layer, and disengagement/detachment from one another, the reactive armor element loses its effectiveness against reactive armor element.

Furthermore, in some cases the jet will not initiate the armor element. For example, the armor element may be struck at an area which is lacking explosive material or comprises a thin layer or where the explosive material detaches from the plate, e.g. upon deformation of the plates owing to mechanical impact by shrapnel, kinetic warheads, etc.

It is thus an object of the present invention to provide a reactive armor element with improved resistance to non-detonating attack, i.e. where the explosive layer detaches from the bearing plate layer and does not detonate. It is a particular object to provide improved contact of the explosive material with the respective plate member, and to minimize the damage of a reactive armor element to local damage only, in case of a non-detonating attack. The invention is further concerned with a method utilizing a reactive armor according to the invention.

SUMMARY OF THE INVENTION

The above objects are achieved by improving the contact of the explosive layer to the plate layer and by compartmenting the explosive material of a reactive armor element.

According to the present invention there is provided a reactive armor element for protection against a shaped-charge warhead comprising a casing fitted with an outer metal cover plate, and at least one explosive matrix extending between the metal plates; said explosive matrix comprising a substantially flat carrier plate formed with a plurality of compartments formed by adjoining divider ribs, with explosive material embedded between said ribs.

One particular embodiment calls for providing a detonation path between the compartments.

According to another aspect of the present invention there is provided an explosive matrix of a reactive armor element for protection against a shaped-charge warhead, said explosive matrix comprising a substantially flat carrier plate formed with a plurality of compartments formed by adjoining divider ribs, with explosive material embedded between said divider ribs. Optionally, a detonation path is formed between the compartments.

The arrangement is such that the thickness of the compartments enables complete detonation of the explosive material throughout the reactive armor element.

According to a particular design, the divider ribs parallely extend from a face of the carrier plate, thereby increasing bending resistance of the matrix. Typically, but not necessarily, the explosive matrix is disposed within the casing such that a ribbed face thereof faces an oncoming shaped charge, and further so, a plate layer is applied over the ribs and in surface contact with the explosive material.

According to one particular design, a non-ribbed face of the carrier plate constitutes a base plate of the casing. According to another design, a non-ribbed face of the carrier plate constitutes the outer cover plate of the casing.

According to one embodiment, adjoining divider ribs are formed with grooves constituting the detonation path, said grooves extending at least part of the height of the divider ribs. The grooves of adjoining divider ribs are preferably aligned.

According to another embodiment of the invention, the compartments are axially partitioned by one or more partitioning members. By one application, the divider ribs are formed with an aligned groove receiving a transverse partitioning member.

The explosive material may be molded or compressed into the compartments of the explosive matrix, whereby the amount of explosive material is controllable. Furthermore, the thickness of the divider ribs and their distribution may be altered, to thereby control the rate of detonation between compartments and the durability of the reactive armor element.

BRIEF DESCRIPTION OF THE DRAWINGS

For better understanding the invention and to see how it may be carried out in practice, some embodiments will now be described, by way of non-limiting examples only, with reference to the accompanying drawings, in which.

DETAILED DESCRIPTION OF THE INVENTION

Figure 1:
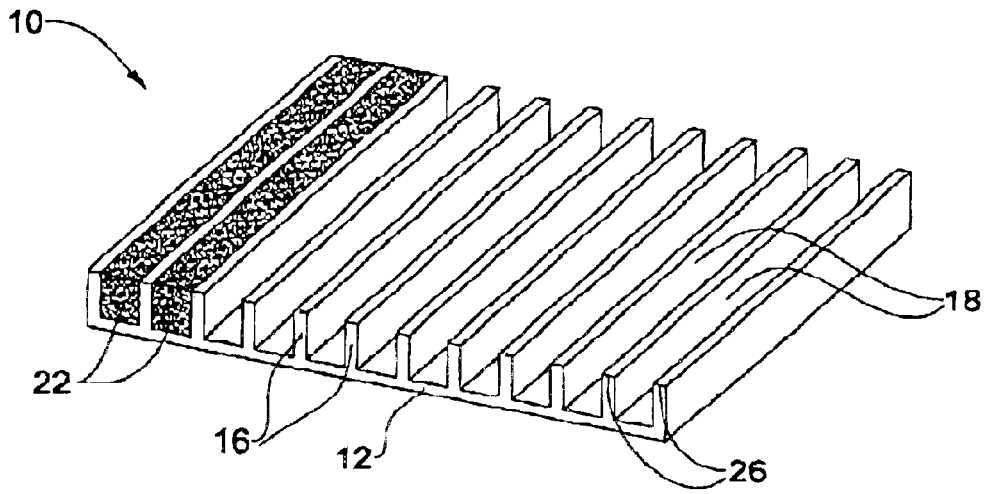
FIG. 1 is an isometric view of an explosive matrix in accordance with a first embodiment of the present invention.

Attention is first directed to FIG. 1 of the drawings illustrating an explosive matrix according to the present invention, generally designated 10, comprising a carrier plate 12 formed with a plurality of integral parallely extending longitudinal divider ribs 16, giving rise to a plurality of compartments 18 extending therebetween. The carrier plate 12 with its integral ribs 16 are made of metal, the ribs being formed by machining or by extrusion. Ribs 16 are of equal height and in the present embodiment the ribs are of equal thickness, equally spaced from one another and are of equal height. However these features may vary as will be illustrated hereinafter.

Received within each compartment 18, there is an explosive material 22 extending flush with the edges 26 of the ribs 16. The arrangement is such that the explosive material 22 occupies the entire space of each compartment 18, tightly bearing against walls of each compartment, constituted by facing surfaces of two adjoining ribs 16 and the respective intermediate surface of the carrier plate 12.

The explosive material 22 may be molded into the compartments 18 or may be compressed into the compartments e.g. by applying a layer of putty-like material over the ribs 16 and introducing it into the compartments by a suitable pass (not shown).

Figure 2:
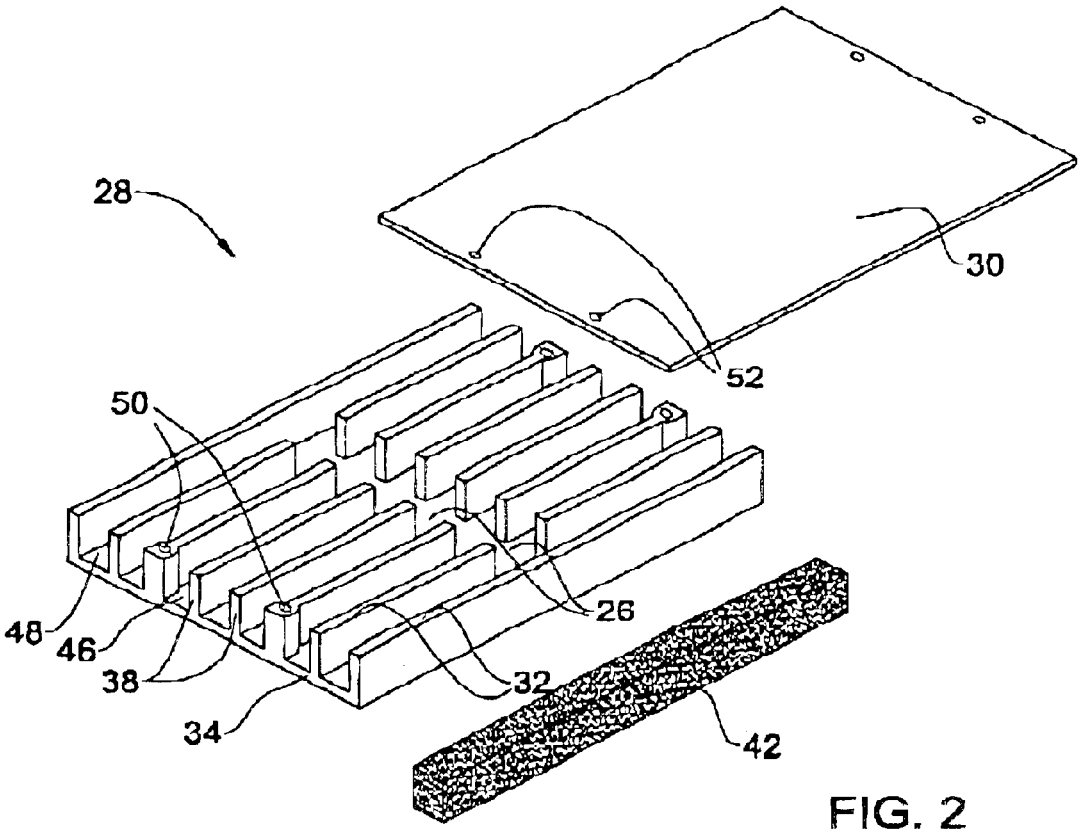
FIG. 2 is an exploded isometric view of an explosive matrix according to another embodiment of the invention.

An explosive matrix 28 of the embodiment illustrated in the exploded view of FIG. 2 is similar to that illustrated in FIG. 1, further showing a plate layer 30 fitted for tightly bearing over edges 32 of divider ribs 38 and explosive material 42. Furthermore, side walls of the ribs 38 and portions 46 of a carrier plate 34 may be roughened or may comprise projections for improving attachment of the explosive material 42 within compartments 48. Alternatively, or in combination, an adhesive agent may be applied on the respective wall surfaces, e.g. polymerizing materials, etc.

Still referring to the embodiment of FIG. 2, the explosive matrix 28 is formed with a detonation path in the form of grooves 26 extending at least part of the height of the divider ribs 38, though preferably the entire height. The purpose of the detonation path is to ensure detonation of the explosive material within adjoining compartments 48. The grooves 26 are aligned in the illustrated example forming a straight path although the grooves may be in a non-aligned pattern forming a non-straight path. The detonation path may alternatively be in the form of tubes (not shown) extending between the compartments 48 or a combination of grooves 26 and tubes.

Figure 4:
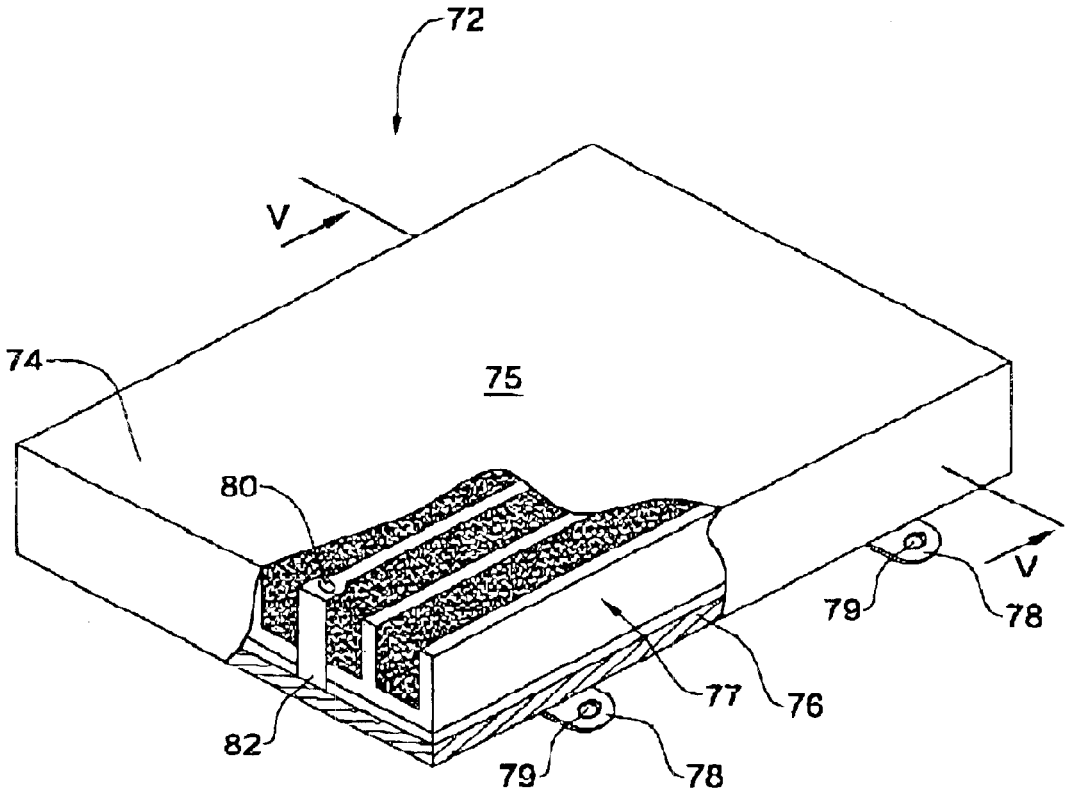
FIG. 4 is a partially sectioned isometric view of a reactive armor element according to the first embodiment of the invention.

Further noted in FIG. 2, the carrier plate is formed with spacer bores 50 integrally formed adjacent the end of some of the divider ribs 38, for attaching thereto the plate layer 30, by means of corresponding holes 52, and for fixing the explosive matrix 42 within a casing of the reactive armor (FIGS. 4 and 5).

Figure 3:
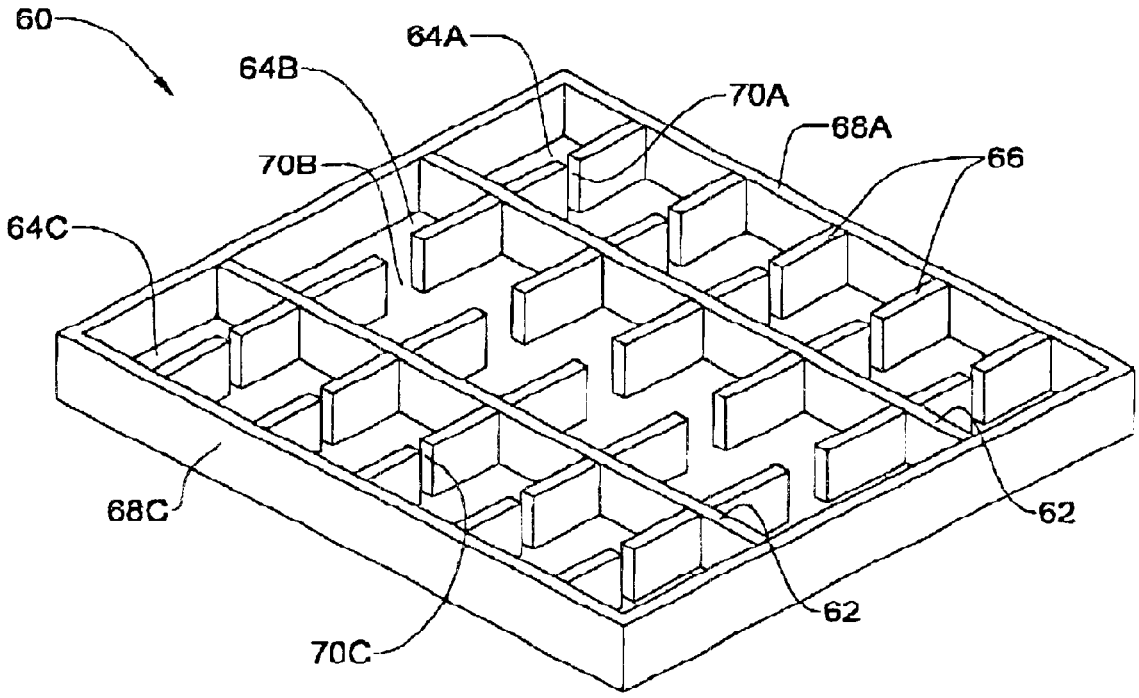
FIG. 3 is an isometric view of an explosive matrix in accordance with still another embodiment of the present invention.

With further attention directed now to FIG. 3 of the drawings, an explosive matrix 60 is shown that is principally similar to those disclosed in the previous embodiments, with the addition of transversally extending partition members 62 dividing the compartments into sub-compartments 64A, 64B and 64C. The partition members 62 may be integrally formed with the carrier plate (in case of manufacturing by a machining process). Alternatively, divider ribs 66 may be formed with aligned recesses sized for snugly receiving the partition members 62, which are straight bars made of metal, composite material, etc. It is noticed that the side compartments 64A and 64C are formed with an edge wall 68A and 68C, respectively. Furthermore, a detonation path extends between adjoining portions of each compartment, by way of recesses 70A, 70B and 70C, respectively.

FIG. 4 is a partially sectioned isometric view of a reactive armor element generally designated 72, according to the present invention and comprising a casing 74 to be attached on the outside of an enclosure (not shown) liable to be exposed to attack by shaped-charge warheads and kinetic energy projectiles. Casing 74 comprises an outer metal cover plate 75 and a metal base plate 76. Fixedly accommodated within the casing 74 there is an explosive matrix 77 as disclosed hereinbefore with reference to the previous FIGS. Attachment of the casing 74 to the enclosure is carried out for example by bolts (not shown) through holes 79 formed in laterally projecting lugs 78. For sake of clarity, a top layer plate (such as layer plate 30 in FIG. 2), is removed. Explosive matrix 77 may be fixedly received within the casing 74 by fasteners such as bolts (not shown) extending through spacer bores 50 integral with the carrier plate (as in the embodiment of FIG. 2) or through spacer bores 80 which retain the explosive matrix 77 at a fixed distance from the base plate 76 by means of a foot or projection 82 of the spacers.

Turning now to FIGS. 5A to 5D, there are illustrated several embodiments of reactive armor elements in accordance with the invention. For easy identification, in FIGS. 5A to 5D, similar elements are given reference numbers identical as in previous embodiments.

Figure 5A:
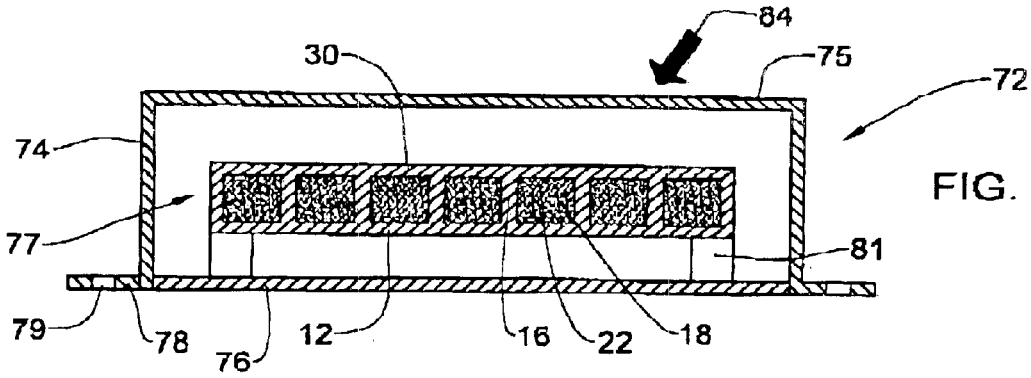
FIGS. 5A to 5D are sectioned side views of reactive armor elements according to further embodiments of the invention.

The reactive armor element 72 in FIG. 5A is a cross-sectioned view along line V—V in FIG. 4, with arrow 84 indicating the expected direction of an oncoming warhead. The explosive matrix 77 is fixed above the base plate 76 by feet 81.

Figure 5B:
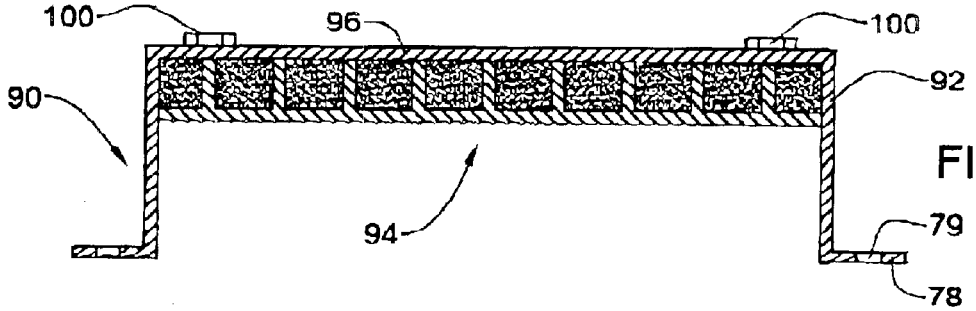

In FIG. 5B there is a reactive armor element 90 with a casing 92, supporting an explosive matrix 94 in a manner such that the outer metal cover plate 96 of the casing 92 constitutes a cover plate layer of the explosive matrix 94. According to such an embodiment, the explosive element may be secured to the casing by bolts 100 extending through the metal cover plate 96.

Figure 5C:
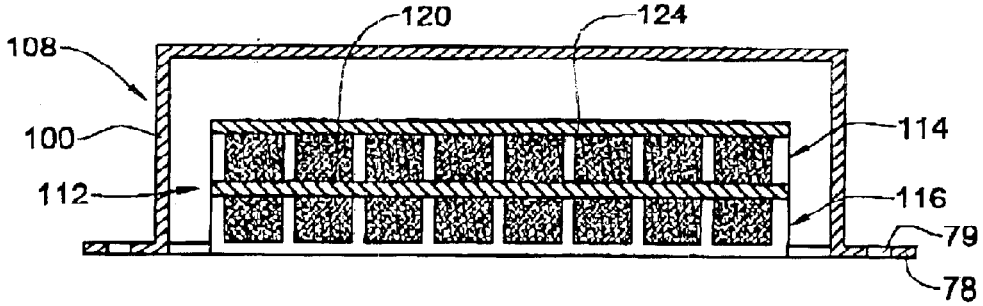

In FIG. 5C a reactive armor element 108 comprises a casing 110 and a explosive matrix generally designated 112 consisting of a top explosive, matrix 114 stacked upon a lower explosive matrix 116 tightly bearing against each other, wherein the top explosive matrix 114 includes a carrier plate 120 whose bottom surface constitutes a plate layer for the lower explosive matrix 116. A top plate layer 124 is provided over the top explosive matrix 114.

Figure 5D:
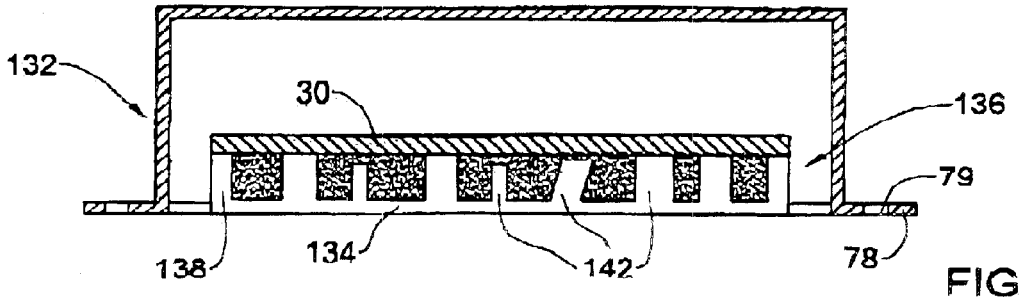

In the embodiment of FIG. 5D there is illustrated a reactive armor element 132 wherein the carrier plate 134 of the explosive matrix 136 constitutes the base plate of the reactive armor element. Furthermore, the divider ribs 142 are not equally spaced and evermore so, some of the divider ribs 142 are thicker than ribs 138, whereby the detonation rate may be controlled. In addition, any or all of the ribs 142 may be inclined with respect to the plane of the carrier plate 134.

What is claimed is:

1. A reactive armor element for protection against a shaped-charge warhead, comprising a casing fitted with an outer metal cover plate, and at least one explosive matrix extending behind the cover plate; the explosive matrix comprising a substantially flat carrier plate and a plurality of adjoining divider ribs joined to the carrier plate to form a plurality of compartments between pairs of the plurality of adjoining divider ribs, with explosive material being embedded between the pairs of the plurality of adjoining divider ribs and occupying an entire space of each of the plurality of compartments.

2. A reactive armor element according to claim 1, wherein a detonation path is formed between at least two adjacent compartments of the plurality of compartments.

3. A reactive armor element according to claim 1, wherein at least one of the plurality of adjoining divider ribs is parallely extended, thereby increasing a bending resistance of the matrix.

4. A reactive armor element according to claim 1, wherein the explosive matrix is disposed within the casing such that one of the plurality of adjoining divider ribs faces an oncoming shaped charge.

5. A reactive armor element according to claim 4, wherein the carrier plate constitutes a base plate of the casing.

6. A reactive armor element according to claim 1, wherein the carrier plate constitutes the outer cover plate of the casing.

7. A reactive armor element according to claim 1, wherein a plate layer is applied over the plurality of adjoining divider ribs and in surface contact with the explosive material.

8. A reactive armor element according to claim 7, wherein the plate layer is one of a base plate and the outer cover plate of the casing.

9. A reactive armor element according to claim 1, wherein at least one of the plurality of adjoining divider ribs is extended at a right angle with respect to a plane of the carrier plate.

10. A reactive armor element according to claim 1, wherein at least one of the plurality of adjoining divider ribs is inclined with respect to a transverse plane of the carrier plate.

11. A reactive armor element according to claim 2, wherein at least one pair of the plurality of adjoining divider ribs is formed with grooves constituting the detonation path, said grooves extending at least part of the height of the at least one pair of the plurality of adjoining divider ribs.

12. A reactive armor element according to claim 11, wherein the grooves of the at least one pair of the plurality of adjoining divider ribs are aligned.

13. A reactive armor element according to claim 1, wherein at least one of the plurality of compartments is axially partitioned by a partitioning member.

14. A reactive armor element according to claim 13, wherein at least one pair of the plurality of adjoining divider ribs forming the at least one of the plurality of compartments is formed with an aligned groove receiving a transverse partitioning member.

15. A reactive armor element according to claim 13, wherein the partitioning member is made of a metal.

16. A reactive armor element according to claim 1, wherein the carrier plate is made of a metal.

17. A reactive armor element according to claim 1, wherein the carrier plate is made of a composite material.

18. A reactive armor element according to claim 1, wherein the explosive is molded into at least one of the plurality of compartments.

19. A reactive armor element according to claim 1, wherein the explosive pressed into at least one of the plurality of compartments.

20. A reactive armor element according to claim 1, wherein the explosive material is adhered within at least one of the plurality of compartments.

21. A reactive armor element according to claim 1, wherein at least one of the plurality of compartments comprises a roughened surface area to improve grip of the explosive material.

22. A reactive armor element according to claim 1, wherein spacer bores extend through at least one of the plurality of adjoining divider ribs for attaching the armor plate.

23. A reactive armor element according to claim 14 wherein the explosive material received within at least one of the plurality of compartments is flush with edges of the pair of the plurality of adjoining divider ribs of the at least one of the plurality of compartments.

24. A reactive armor element according to claim 1 wherein the explosive material received within at least one of the plurality of compartments is of a uniform thickness and a uniform density.

25. A reactive armor element according to claim 1, wherein at least two of the plurality of adjoining divider ribs comprise one of a different height, thickness and spacing.

26. A reactive armor element according to claim 1, comprising a plurality of explosive matrixes disposed within the casing, substantially parallel and adjacent to one another.

27. A reactive armor element according to claim 1, wherein the reactive armor element is an add-on armor type.

28. An explosive matrix of a reactive armor element for protection against a shaped-charge warhead, said explosive matrix comprising a substantially flat carrier plate and a plurality of adjoining divider ribs joined to the carrier plate to form a plurality of compartments between pairs of the plurality of adjoining divider ribs, with explosive material being embedded between the pairs of the plurality of adjoining divider and occupying an entire space of each of the plurality of compartments.

29. An explosive armor element according to claim 28, wherein a detonation path is formed between at least two adjacent compartments of the plurality of compartments.

30. An explosive matrix according to claim 28, wherein at least one of the plurality of adjoining divider ribs is parallely extended, thereby increasing a bending resistance of the matrix.

31. An explosive matrix according to claim 28, wherein at least one of the plurality of adjoining divider ribs is extended at a right angle with respect to a plane of the carrier plate.

32. An explosive matrix according to claim 28, wherein at least one of the plurality of adjoining divider ribs is inclined with respect to a plane of the carrier plate.

33. An explosive matrix according to claim 29, wherein at least one pair of the plurality of adjoining divider ribs is formed with grooves constituting the detonation path, said grooves extending at least part of the height of the at least one pair of the plurality of adjoining divider ribs.

34. An explosive matrix according to claim 28, wherein the grooves of the at least one pair of the adjoining divider ribs are aligned.

35. An explosive matrix according to claim 28, wherein at least one of the plurality of compartments is axially partitioned by a partitioning member.

36. An explosive matrix according to claim 35, wherein at least one pair of the plurality of adjoining divider ribs is formed with an aligned groove receiving a transverse partitioning member.

37. An explosive matrix according to claim 35, wherein the partitioning is made of a metal.

38. An explosive matrix according to claim 28, wherein the carrier plate is made of a metal.

39. An explosive matrix according to claim 28, wherein the carrier plate is made of a composite material.

40. An explosive matrix according to claim 28, wherein the explosive material is molded into at least one of the plurality of compartments.

41. An explosive matrix according to claim 28, wherein the explosive material is pressed into at least one of the plurality of compartments.

42. An explosive matrix according to claim 28, wherein the explosive material is adhered within at least one of the plurality of compartments.

43. An explosive matrix according to claim 28, wherein at least one of the plurality of compartments comprises a roughened surface area to improve grip of the explosive material.

44. An explosive matrix according to claim 28, wherein spacer bores extend through at least one of the plurality of divider ribs for attaching the armor plate.

45. An explosive matrix according to claim 28, wherein the explosive material received within at least one of the plurality of compartments is flush with edges of the pair of the plurality of adjoining divider ribs of the at least one of the plurality of compartments.

46. An explosive matrix according to claim 28, wherein the explosive material received within at least one of the plurality of compartments is of a uniform thickness and a uniform density.

47. An explosive matrix according to claim 28, wherein the pairs of the plurality of adjoining divider ribs comprise one of a different height, thickness and spacing.

48. An explosive matrix according to claim 28, wherein a plate layer is applied over the plurality of adjoining divider ribs and in surface contact with the explosive material.

49. An explosive matrix according to claim 28, wherein at least two of the plurality if adjoining divider ribs are of equal height.

50. A method of protecting an enclosure a optionally against kinetic stress, comprising the step of:

fitting the enclosure on an outside with a reactive armor element comprising a casing fitted, with an outer metal cover plate and a metal base plate, and at least one explosive matrix extending behind the cover plate; the explosive matrix comprising a substantially flat carrier plate and a plurality of adjoining divider ribs joined to the carrier plate to form a plurality of compartments between pairs of the plurality of adjoining ribs; with explosive material being embedded between the pairs of the plurality of adjoining divided ribs and occupying an entire space of each of the plurality of compartments.

51. A method according to claim 50, wherein a detonation path is formed between at least two adjacent compartments of the plurality of compartments.

52. A method according to claim 50, further comprising the step of forming the plurality of adjoining divider ribs with detonation paths extending between the plurality of compartments of the explosive matrix.

53. A method according to claim 50, further comprising the step of axially partitioning at least one of the plurality compartments by a partitioning member.

* * * * *